United States Patent [19]

Giroux et al.

[11] Patent Number: 5,011,338

[45] Date of Patent: Apr. 30, 1991

[54] CANAL TRIMMING MACHINE

[75] Inventors: D. William Giroux, LaConner, Wash.; James N. Ferry, Elkhorn, Nebr.; Kendall J. Kelly, Woodbine; Thomas G. Bell, Ida Grove, both of Iowa 51455; Conway P. Narby, Rancho Santa Margarita; Gary L. Patburg, Brea, both of Calif. 92621

[73] Assignee: Kiewit Construction Group, Inc. Omaha, Nebr. and Goobersen-Smith Construction Company, Idagrove, Iowa.

[21] Appl. No.: 507,615

[22] Filed: Apr. 10, 1990

[51] Int. Cl.[5] ..... E02B 5/02

[52] U.S. Cl. ..... 405/268; 37/80 A; 405/303

[58] Field of Search ..... 405/268, 303, 270, 271, 405/38, 258; 37/80 R, 80 A; 404/96, 100, 101

[56] References Cited

U.S. PATENT DOCUMENTS

| | | | |
|---|---|---|---|
| 2,090,959 | 8/1937 | Jackson | 405/268 |
| 2,094,974 | 10/1937 | Wood | 405/268 |
| 2,169,468 | 8/1939 | McDougall et al. | 37/80 A X |
| 2,308,294 | 1/1943 | McCorkle et al. | 405/270 |
| 2,333,287 | 11/1943 | Baird | 405/268 X |
| 2,444,811 | 7/1948 | Crom | 405/268 |
| 2,975,602 | 3/1961 | Stromberg | 405/268 |
| 3,182,459 | 5/1965 | Gretner et al. | 405/270 X |
| 4,050,972 | 9/1977 | Cardinal | 405/270 X |
| 4,360,293 | 11/1982 | Wade | 405/268 |
| 4,472,089 | 9/1984 | Bruderle et al. | 405/268 |
| 4,557,633 | 12/1985 | Dyck | 404/100 X |
| 4,720,212 | 1/1988 | Steenbergen | 405/38 X |
| 4,828,432 | 5/1989 | Iyes | 405/270 |

FOREIGN PATENT DOCUMENTS

| | | | |
|---|---|---|---|
| 0715695 | 2/1980 | U.S.S.R. | 405/268 |
| 1170035 | 7/1985 | U.S.S.R. | 405/268 |
| 1170036 | 7/1985 | U.S.S.R. | 405/268 |

OTHER PUBLICATIONS

Mud Cat Brochure, Elliott Machine Corp.

*Primary Examiner*—Dennis L. Taylor

[57] ABSTRACT

A canal trimming machine is disclosed which is designed to trim the bottom and sides of an earthen canal so that the canal may be lined and paved. The machine comprises a frame which extends across the width of the canal and which has propelling tracks at the opposite ends thereof which are driven along the canal in the proper direction and at the proper grade. A trimmer is longitudinally movably mounted on the frame and trims at least one-half of the bottom and a majority of one side of the canal. The trimmer is automatically positioned at the proper grade to ensure that the bottom and sides of the canal will be properly prepared for the lining and paving operation. A rock spreader is also mounted on the frame and trails behind the trimmer to fill low spots in the canal so that an even surface will be provided for the lining and trimming operation.

28 Claims, 14 Drawing Sheets

CANAL TRIMMING MACHINE

TECHNICAL FIELD

The present invention relates generally to a machine for trimming an earthen canal prior to the canal being lined with a water-impervious layer of material to enable a concrete layer to be placed thereupon.

BACKGROUND OF THE INVENTION

Many of the older irrigation canals are prone to leakage since they are formed with a compacted silt bottom and sloped sides. In some locations, a canal may run through extremely porous material resulting in serious leakage problems of yet greater concern.

One method for repairing such leaking canals is to install an impermeable lining in the canal. Heretofore this was not possible while water continued to flow in the canal. Thus the water would have to be diverted or retained while the lining was installed which meant that some areas would be without water during the lining process.

In the application entitled "Method and Apparatus for Lining a Canal", Ser. No. 395,811 filed Aug. 18, 1989, now U.S. Pat. No. 4,954,019 a method and apparatus for lining a canal is described. In the device of the above-identified application, a method and means is described for lining and paving the irrigation canal while water was flowing therein. The apparatus of the above-identified application comprises an elongated frame means which extends transversely across the canal and which has propelling track members at the opposite ends thereof to propel the frame means along the length of the canal. A concrete laying mechanism or concrete paver is supported on the frame means and is designed to lay concrete on at least a portion of one of the sides of the canal and on at least a portion of the bottom of the canal as the frame means is moved along the length of the canal. Prior to the concrete being placed in the canal, a flexible sheet material is positioned on the bottom and sides of the canal with the concrete being placed thereon.

In the method and means of the above-identified application, it is necessary for the bottom and the sides of the canal to be trimmed and/or filled to enable the flexible sheet material and concrete to be placed on a substantially smooth surface at the desired grade. In other words, the sheet laying apparatus and the concrete paver are designed to lay the sheet material and concrete on a relatively even surface having a predetermined grade. Inasmuch as water is flowing in the canal during the trimming operation, it is difficult to monitor the trimming apparatus since the trimming apparatus is normally operating beneath the water making it difficult to achieve the desired grade for the bottom and the sides of the canal.

A canal paving machine is described in U.S. Pat. No 4,360,293 which is designed to trim the bottom and sides of the canal and to place a layer of concrete thereon. However, the machine of U.S. Pat. No. 4,360,293 employs a trimming apparatus which is of a fixed configuration which must be replaced when canals of different sizes and grades are being trimmed. Further, the trimming apparatus of U.S. Pat. No. 4,360,293 is designed to trim a canal wherein water is not flowing therein. Additionally, the machine of U.S. Pat. No. 4,360,293 does not include any means for filling low spots in the canal bottom or sides.

It is therefore a principal object of the invention to provide a machine for trimming a canal.

Still another object of the invention is to provide a machine for trimming a canal wherein the trimming operation is conducted while water is flowing in the canal.

Still another object of the invention is to provide a canal trimming machine which includes means for filling low spots in the canal.

Still another object of the invention is to provide a canal trimming machine which includes guidance means for the trimmer so that the canal will be trimmed to a precise grade.

Yet another object of the invention is to provide a canal trimming machine including a guidance means which may be modified to conform to different canal grades.

Still another object of the invention is to provide a canal trimming machine including a guidance means which automatically compensates for downward deflection of the supporting structure as the trimmer moves longitudinally thereon.

Still another object of the invention is to provide a canal trimming machine including means for quickly and easily raising the trimmer with respect to the canal to enable the trimmer to be returned to its starting position.

Still another object of the invention is to provide a canal trimming machine which includes means for trimming "high" spots in the canal and means for filling low spots in the canal.

These and other objects will be apparent to those skilled in the art.

SUMMARY OF THE INVENTION

A canal trimming machine is described and includes an elongated frame which extends transversely across the canal to be trimmed and which has opposite ends, a forward end and a rearward end. Propelling track members are provided at the opposite ends of the elongated frame for propelling the frame along the length of the canal. The propelling track members are guided by a conventional guidance means so that the machine is properly propelled along the length of the canal at the proper grade. A canal trimming apparatus is longitudinally movably mounted on the frame and includes a rotary trimmer having its rotational axis disposed parallel to the longitudinal axis of the canal. The trimming apparatus is moved back and forth along a substantial portion of the length of the frame to trim at least a portion of the bottom of the canal and at least a portion of one side of the canal. The machine also includes a rock spreader means which follows the trimmer as the machine is moved along the length of the canal for filling low spots in the canal with rock material.

A pair of trimmers are also attached to the frame adjacent one end thereof for trimming the upper portion of one of the side walls of the canal and for trimming a horizontal portion at that end of the frame upon which concrete will be positioned when the canal is subsequently paved. The machine includes a guidance means which controls the vertical displacement of the rotary trimmer so that the desired grade is formed in the bottom of the canal and at least a portion of one side of the canal. The guidance means also includes means enabling the machine to compensate for downward deflection in the frame as the trimming apparatus moves thereon to ensure that the canal is trimmed to the proper grade.

When the machine reaches a siphon location along the canal, the machine is turned 180° and then moved back along the length of the canal just traversed so that the remainder of the bottom and the other side wall of the canal may be trimmed and/or filled. The material trimmed from the rotary trimmer is pumped to a location outwardly of the canal so that the trimmed material is not reintroduced into the canal.

DESCRIPTION OF THE PREFERRED EMBODIMENT

Figure 1:
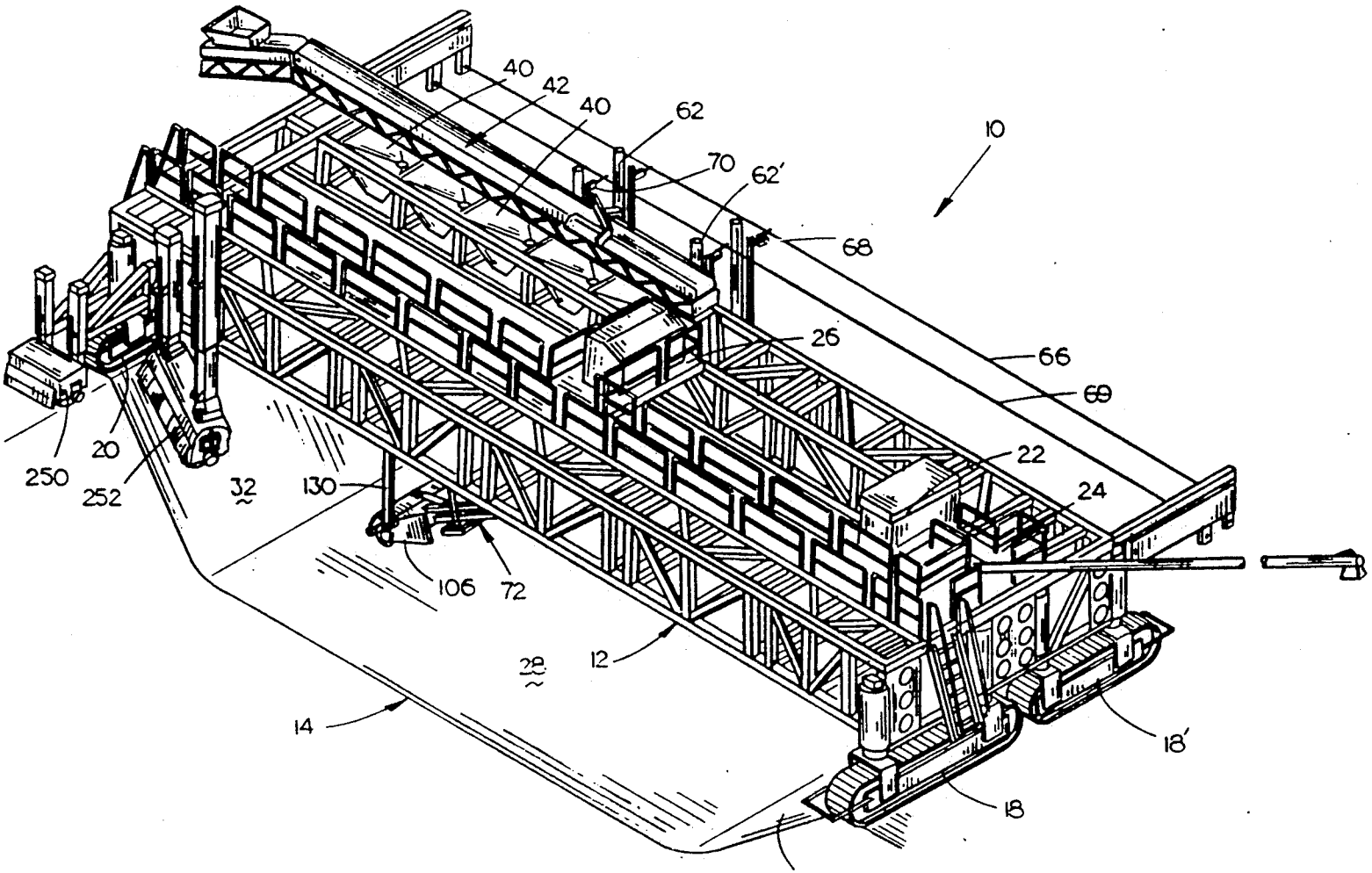
FIG. 1 is a perspective view illustrating the trimmer of this invention positioned over a canal.
Figure 2:
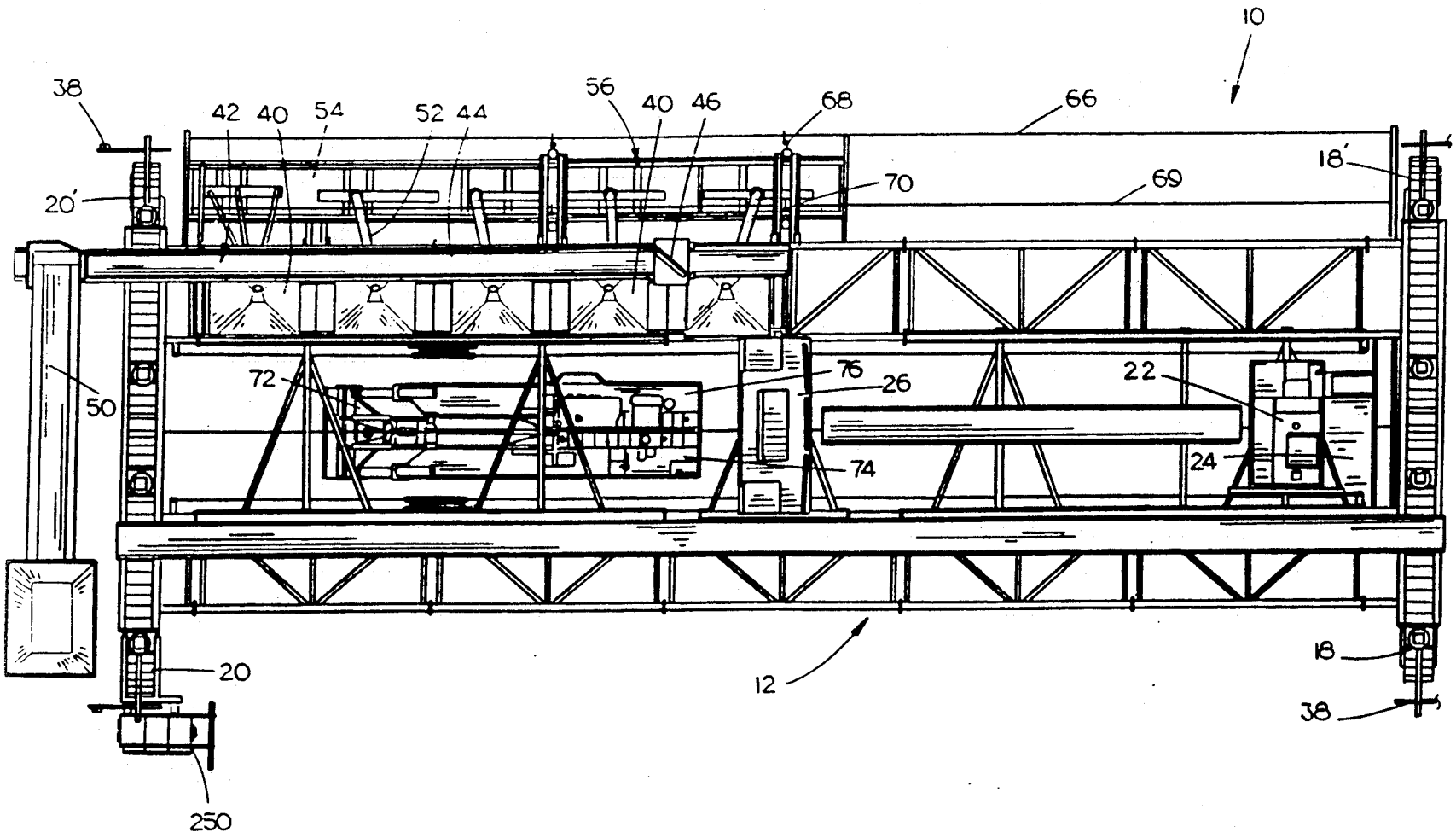
FIG. 2 is a top view of the trimmer of this invention.
Figure 3:
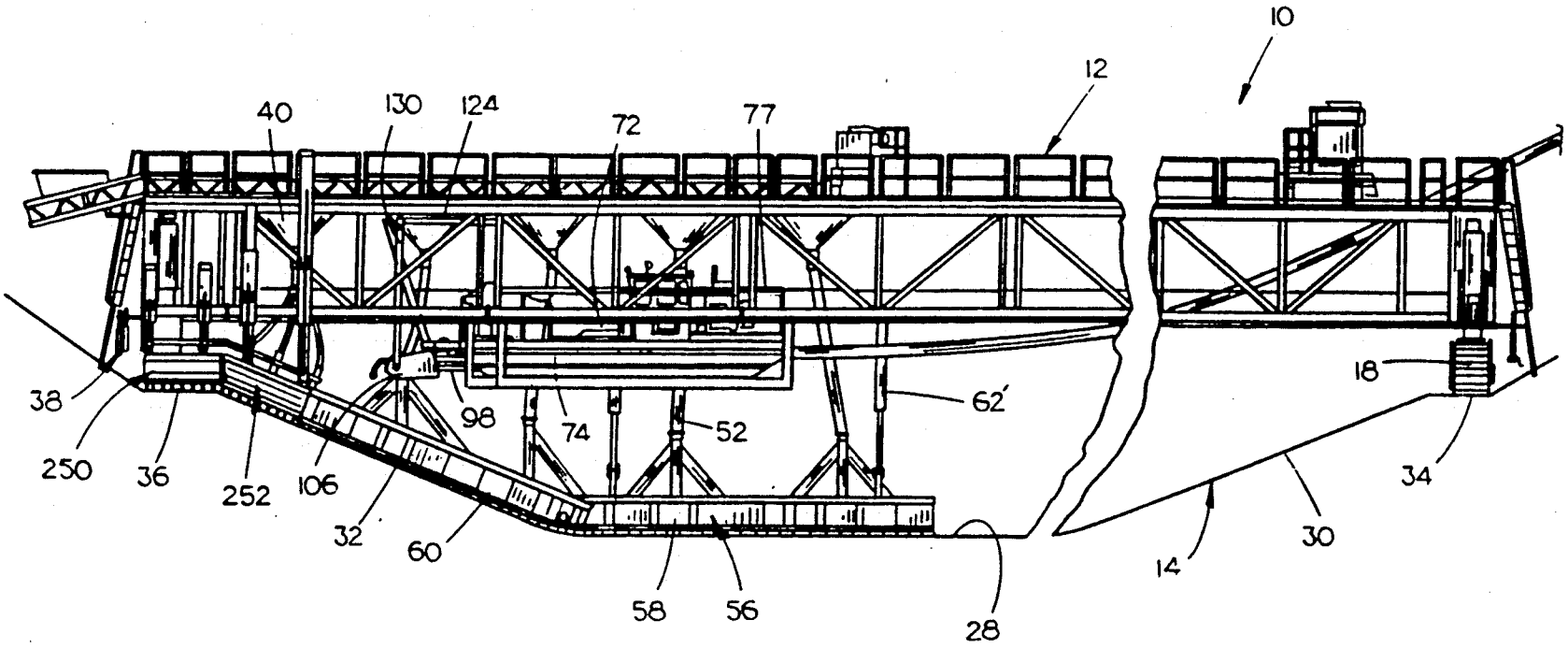
FIG. 3 is a partial side view of the trimmer of this invention as seen from the left side of FIG. 1.
Figure 4:
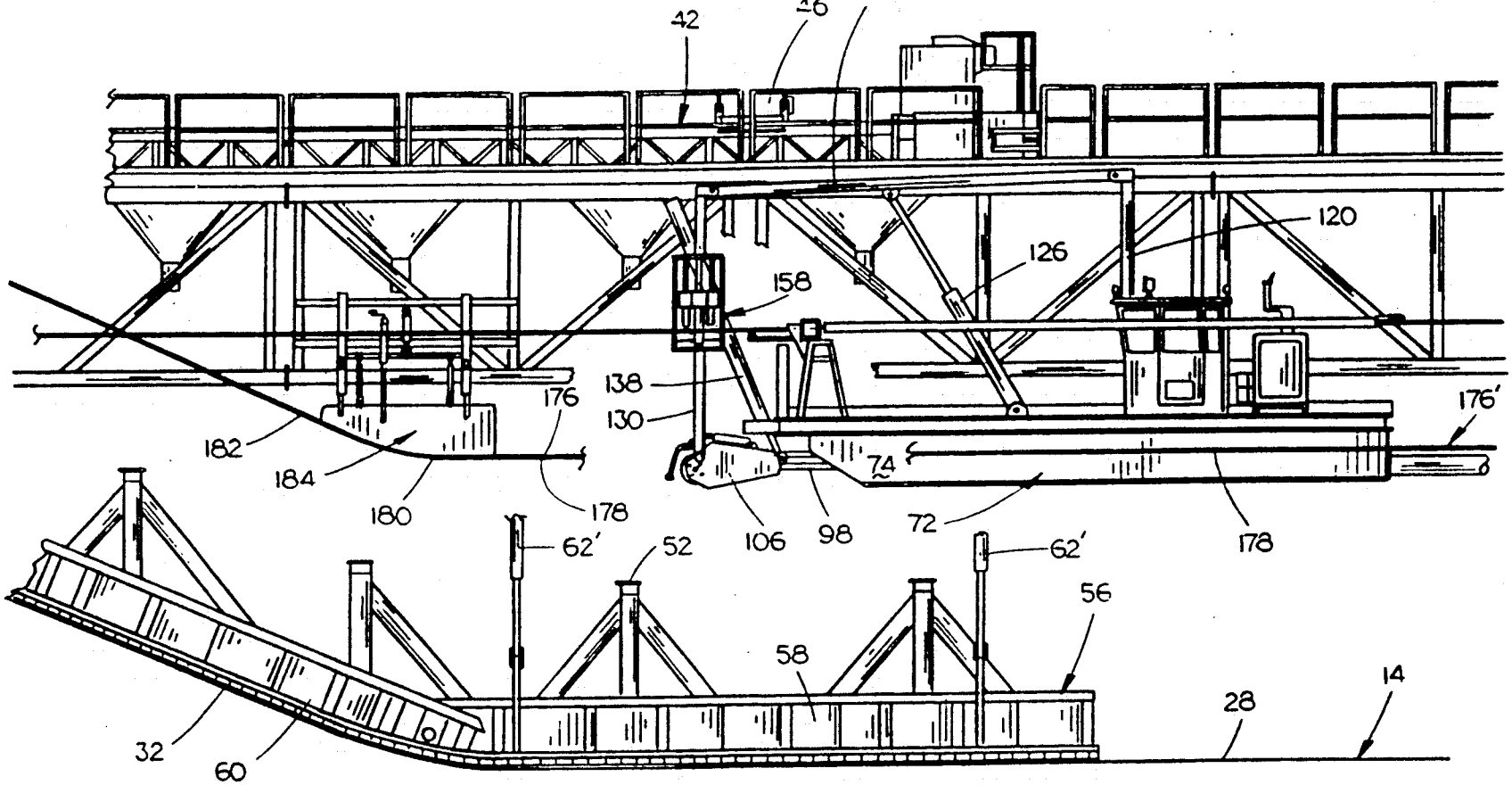
FIG. 4 is a partial side view as seen from the left of FIG. 1.
Figure 5:
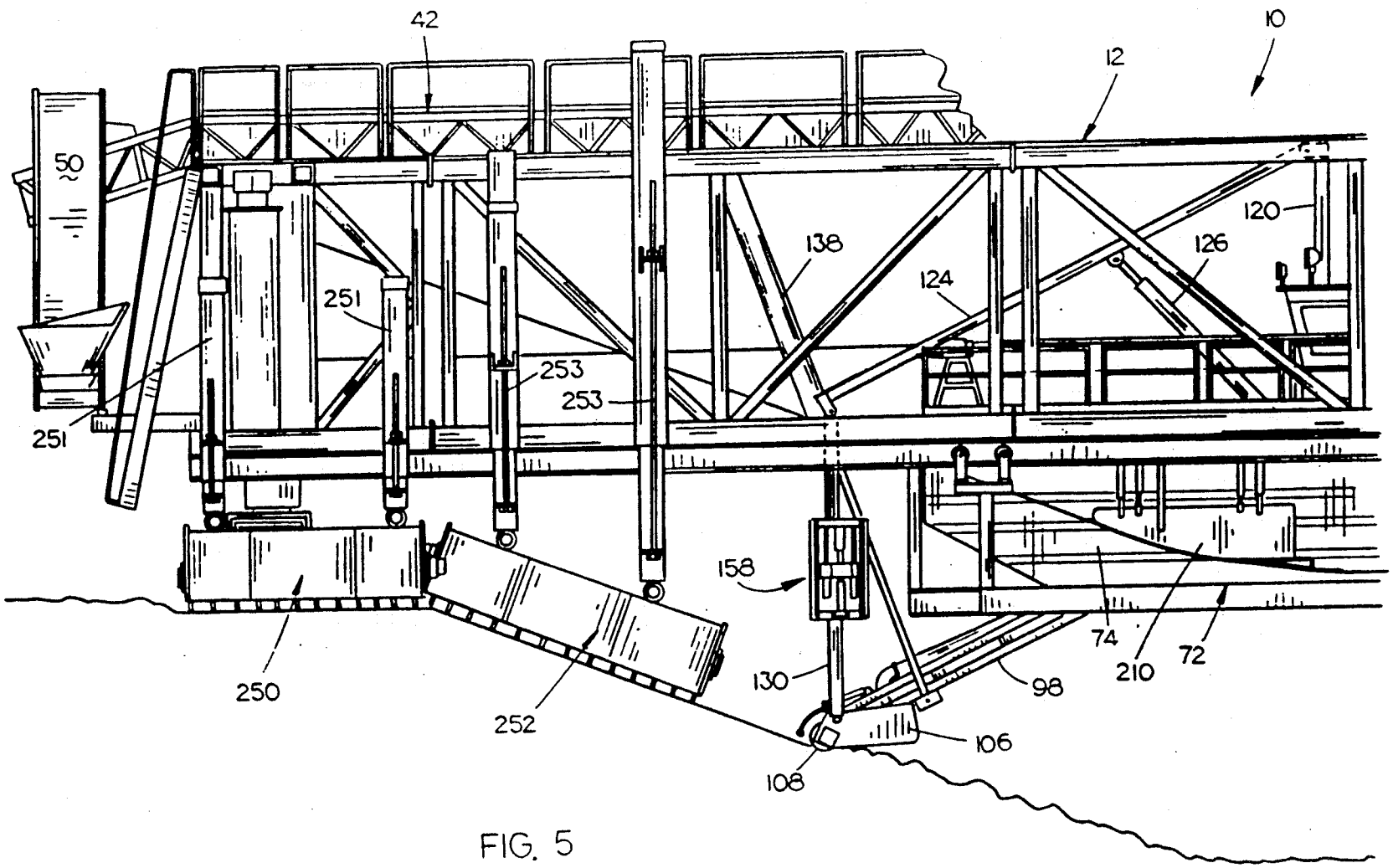
FIG. 5 is a partial side view similar to FIG. 3 except that the trimmer head has been lowered into engagement with the canal.
Figure 6:
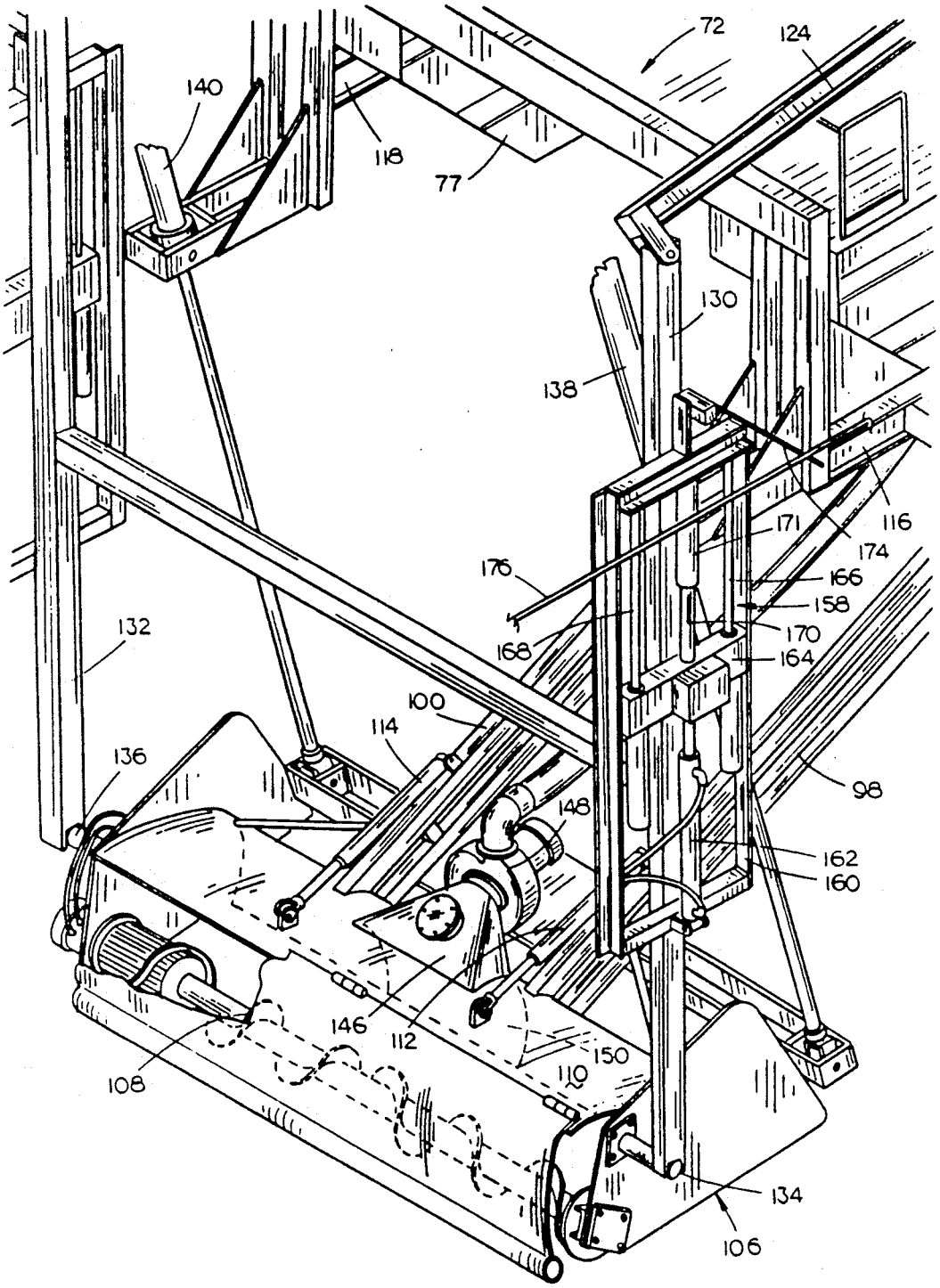
FIG. 6 is a front perspective view of the trimmer head with some of the related structure.
Figure 7:
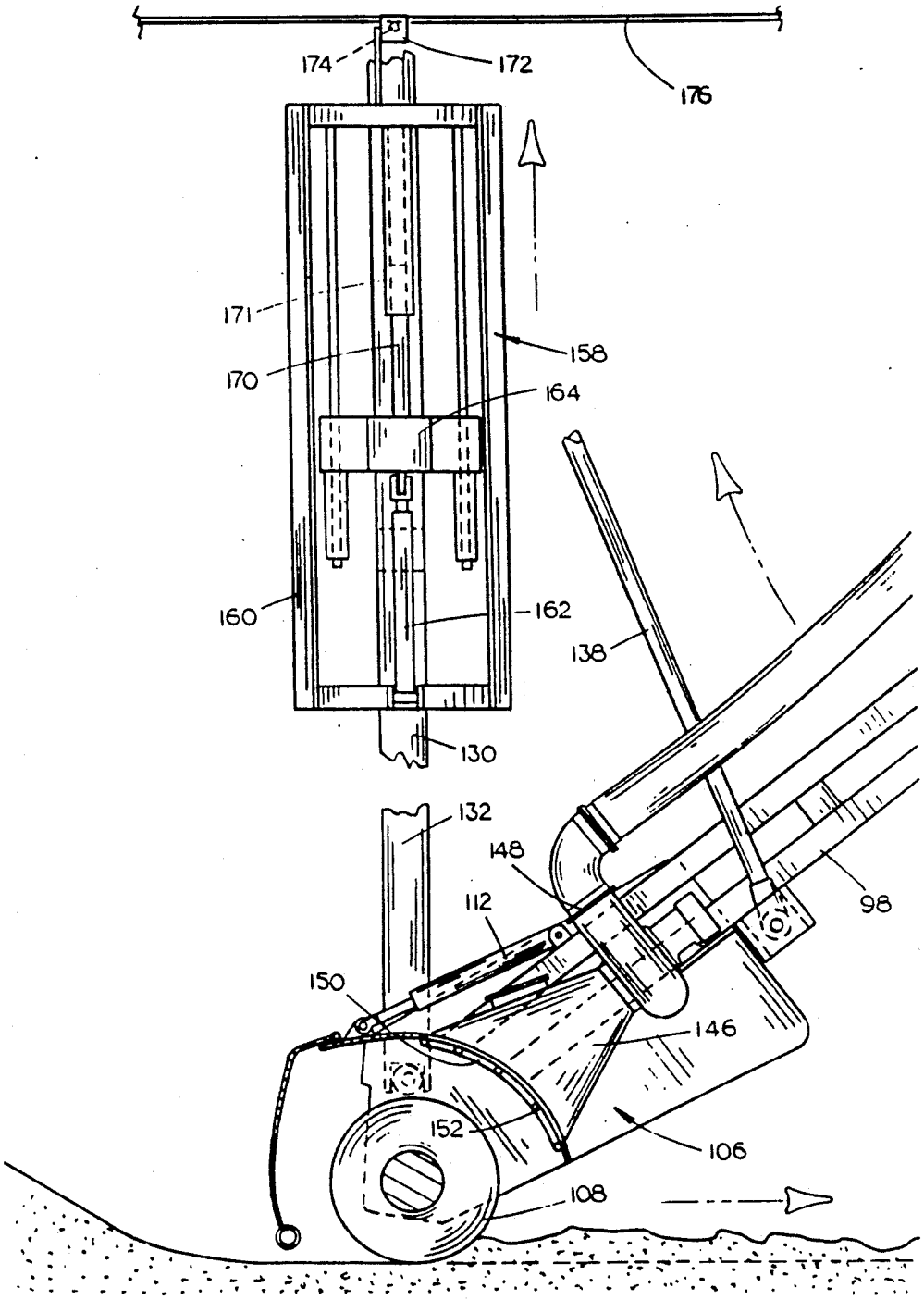
FIG. 7 is a side elevational view of the trimmer head.
Figure 8:
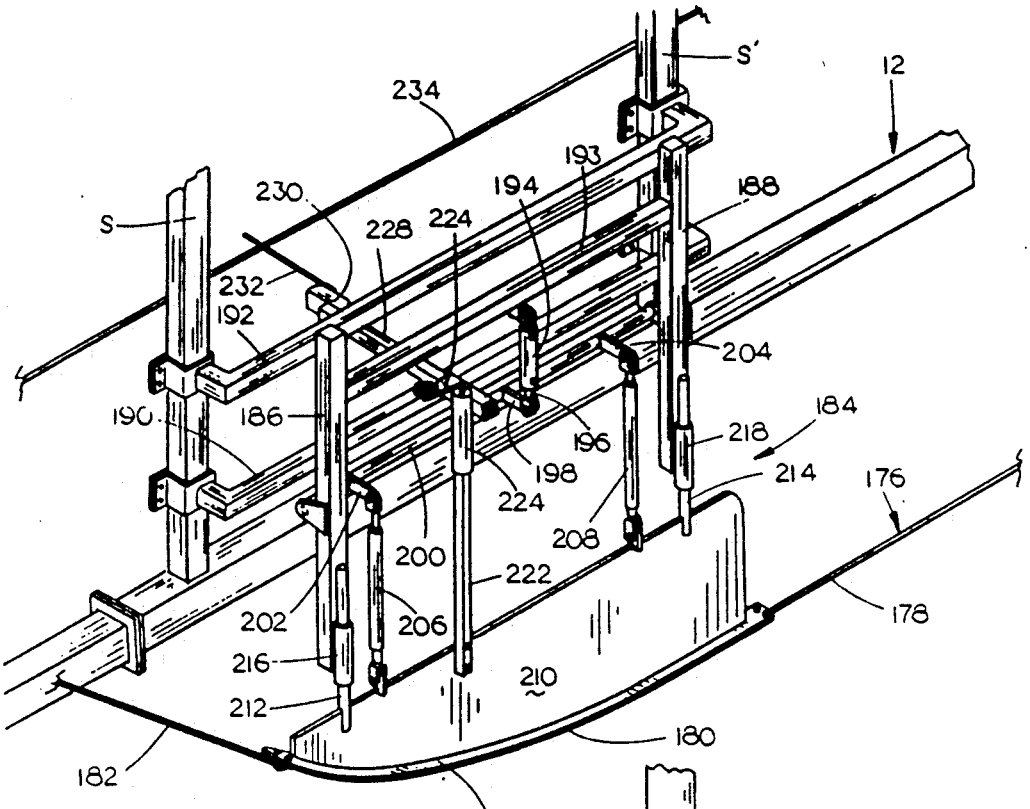
FIG. 8 is a perspective view of one of the string sensored radius assemblies.
Figure 9:
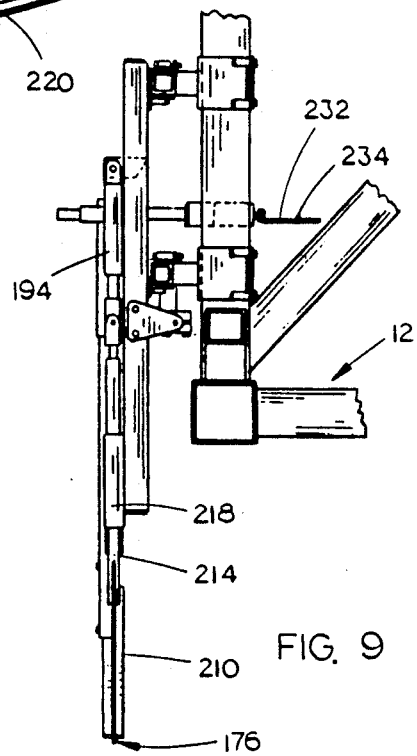
FIG. 9 is an end view of the structure of FIG. 8 as seen from the right of FIG. 8.
Figure 10:
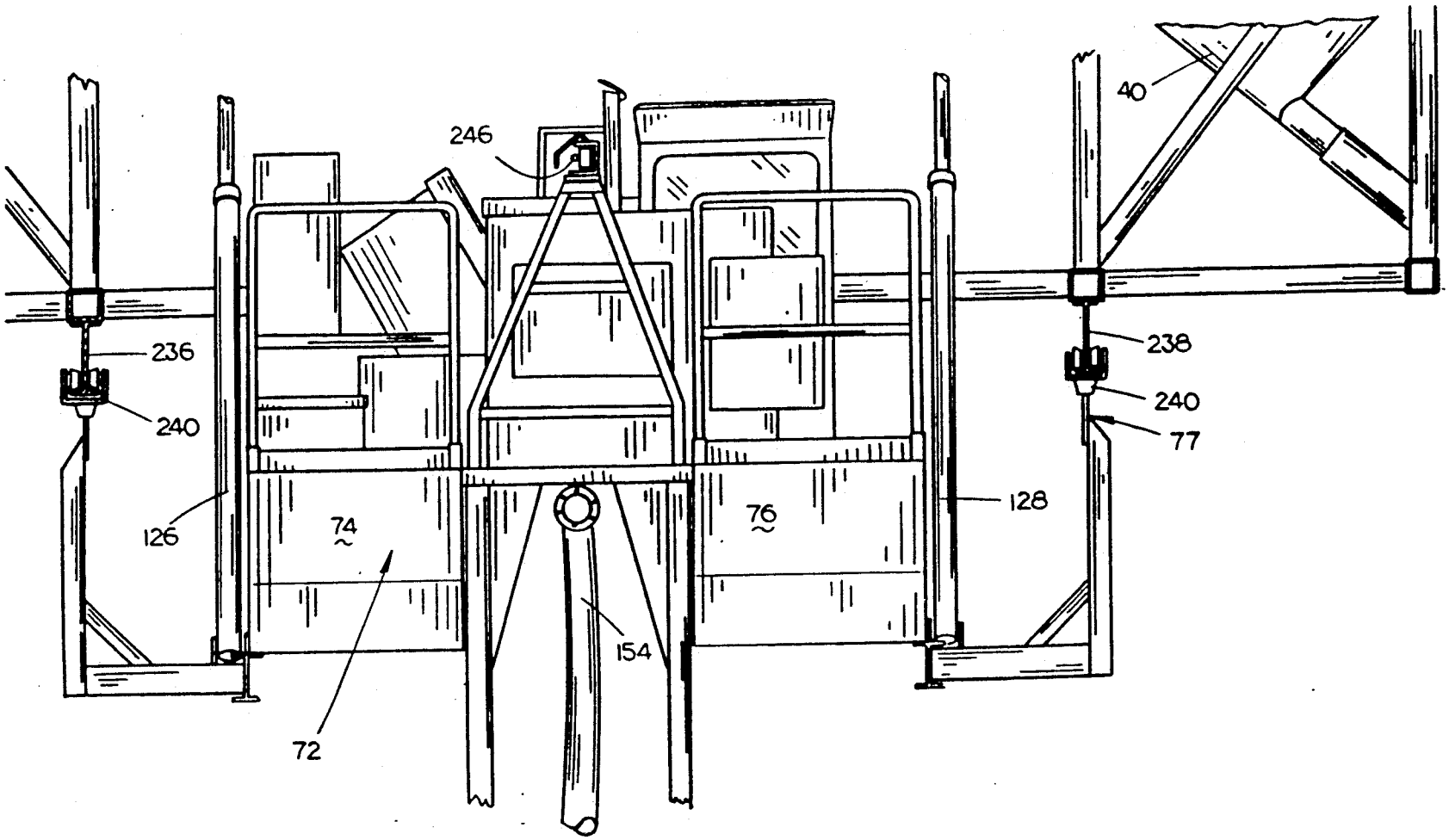
FIG. 10 is a partial rear sectional view illustrating the trimmer means mounted on its supporting carriage.
Figure 11:
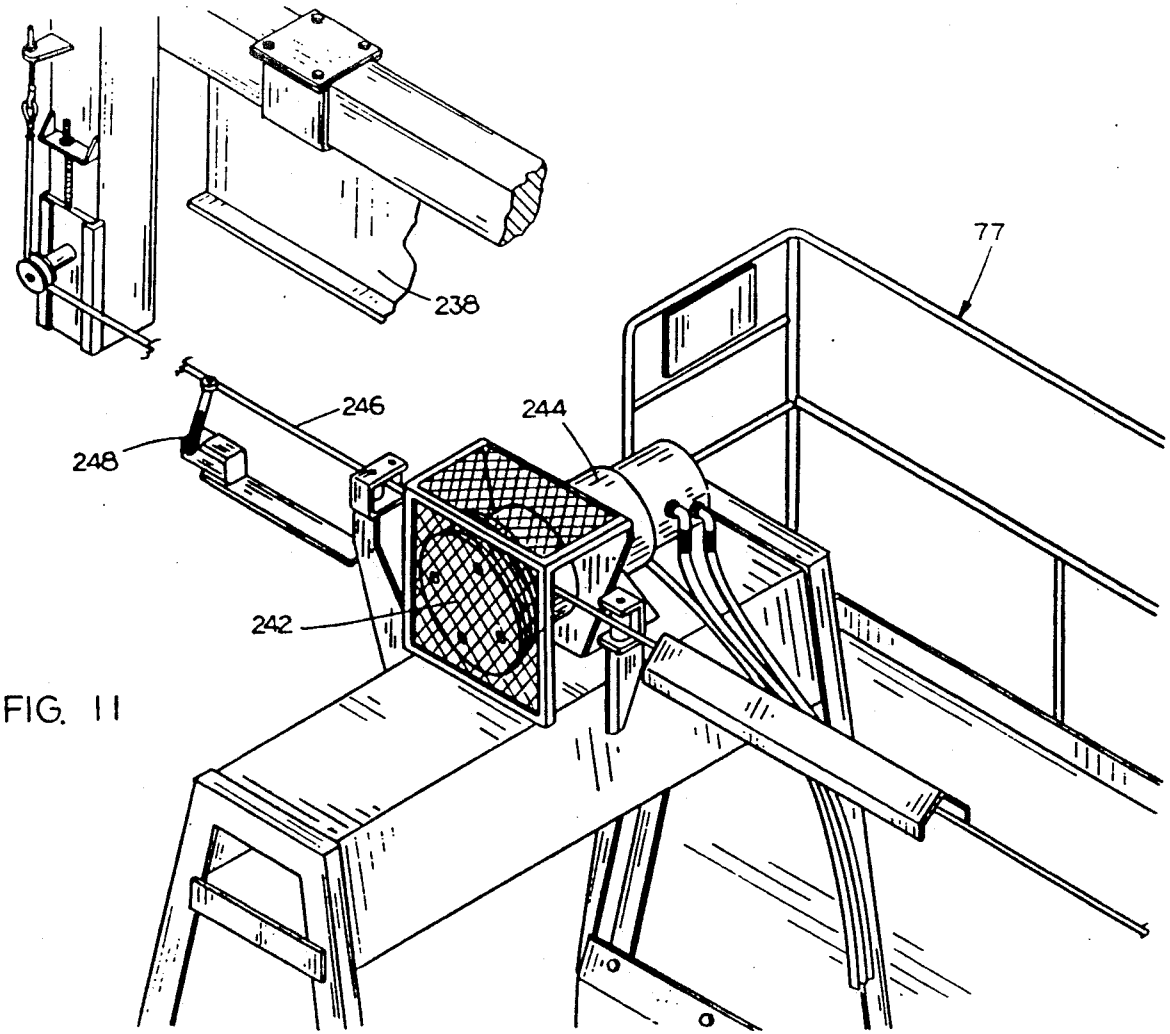
FIG. 11 is a perspective view of the means for moving the trimmer on the frame.
Figure 12:
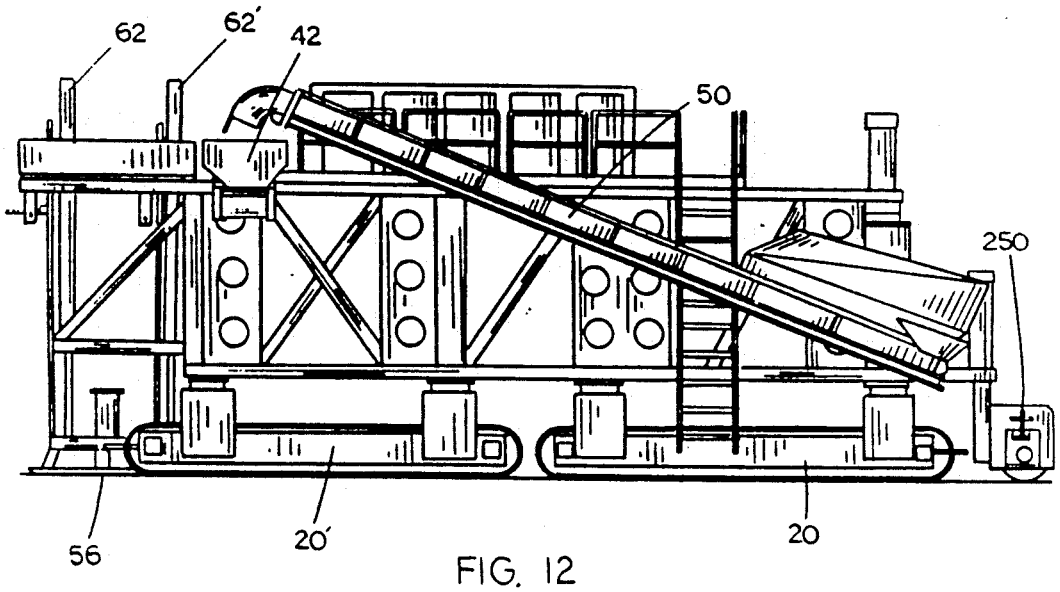
FIG. 12 is an end view of the invention.
Figure 13:
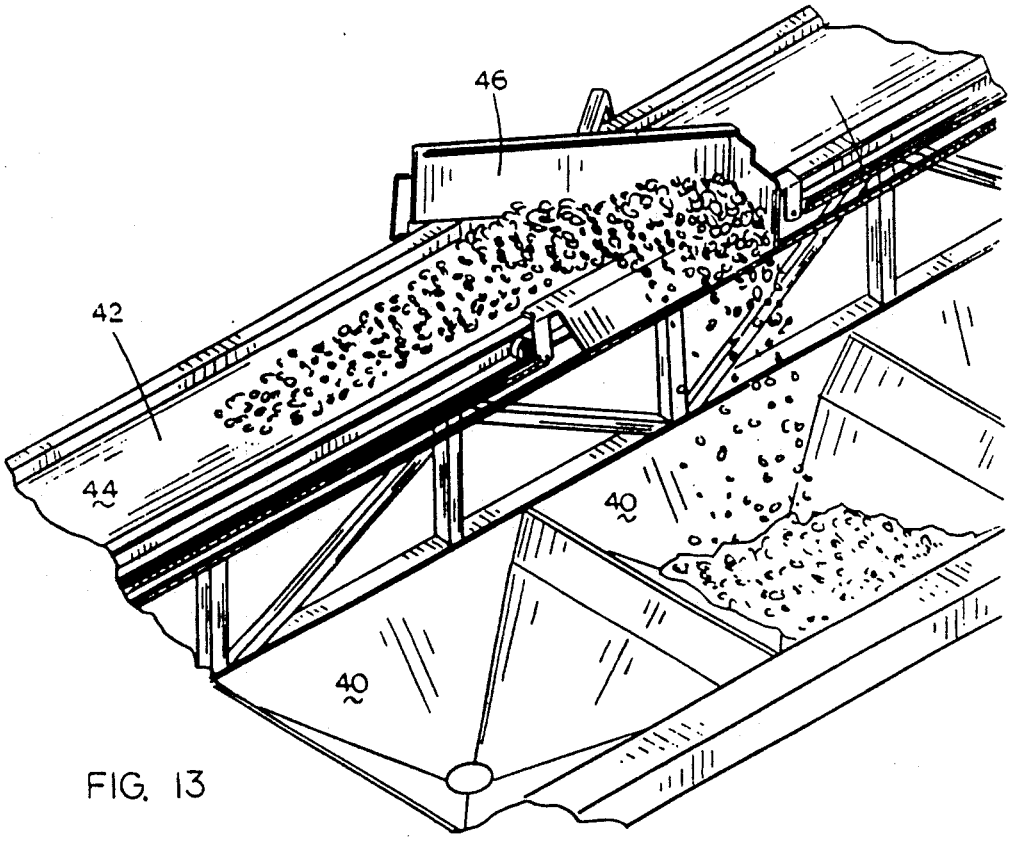
FIG. 13 is a partial perspective view illustrating the manner in which rock material is diverted from the conveyor into the hoppers.

Referring now to the drawings, especially FIG. 1, in which similar or corresponding parts are identified with the same reference numeral, the canal trimming machine of the present invention is generally designated at 10, and includes an elongated frame means 12 extending tranversely across a canal 14 having water flowing therein, and having driven tracks 18 and 18' at one end thereof and driven tracks 20 and 20' at the other end thereof for moving frame means 12 along the canal 14. Conventional hydraulic cylinders interconnect the frame means 12 and the tracks 18, 18' and 20, 20' to permit frame means 12 to be raised and lowered with respect to the tracks. The machine is powered by conventional power means such as a diesel engine 22 or the like located at operator's station 24. A second operator's station 26 is also provided on the frame means 12.

For purposes of description, canal 14 will be described as comprising a bottom 28 and opposite sides 30 and 32. Prior to the trimming operation, a large excavation machine will be utilized to create paths 34 and 36 at opposite sides of the canal to permit the tracks to move thereupon. A conventional grade line and sensing mechanism 38 is employed along each of the paths 34 and 36 for guiding the tracks along the paths 34 and 36 respectively at the proper grade.

A plurality of rock hoppers 40 are positioned longitudinally on the frame means 12 adjacent the upper end thereof. A substantially horizontally disposed conveyor 42 extends across the top of the hoppers 40 and includes an upper belt portion 44. The numeral 46 refers to an angled strike-off plate which is longitudinally movably mounted with respect to the conveyor 42 and which is adapted to engage the rock material moving on the upper belt portion 44 to deflect or divert the rock material into a particular individual hopper 40 as desired. A chain means 48 is operatively connected to the strike-off plate 46 for selectively moving the plate 46 to the desired location. A second conveyor 50 supplies the rock material to the conveyor 42.

At least one tube 52 extends from each of the hoppers 40 downwardly to compartments 54 in a spreader means 56 which includes a substantially horizontally disposed portion 58 and an inclined portion 60 hingedly secured thereto about a horizontal axis which extends upwardly from the outer end of horizontal portion 58 at the same angle as the side wall 30 or 32. The lower ends of the compartments 54 in the spreader means 56 are positioned closely adjacent the bottom or side of the canal and are designed to fill low spots in the trimmed canal with rock material with the rock material having a consistency such that it will not wash prior to the canal being lined and paved.

A plurality of vertically disposed hydraulic cylinders 62 connect the rearward end of spreader means 56 with frame means 12 to enable the rearward end of the spreader means 56 to be vertically positioned as desired. Similarly, a plurality of hydraulic cylinders 62' connect the forward end of spreader means 56 to frame 12 to enable the forward end of spreader means 56 to be vertically positioned as required. A plurality of angularly disposed cylinders 64 extend upwardly and forwardly from the forward end of spreader means 56 to the frame means 12 to stabilize the spreader means 56 as the machine is moved along the length of the canal.

Figure 14:
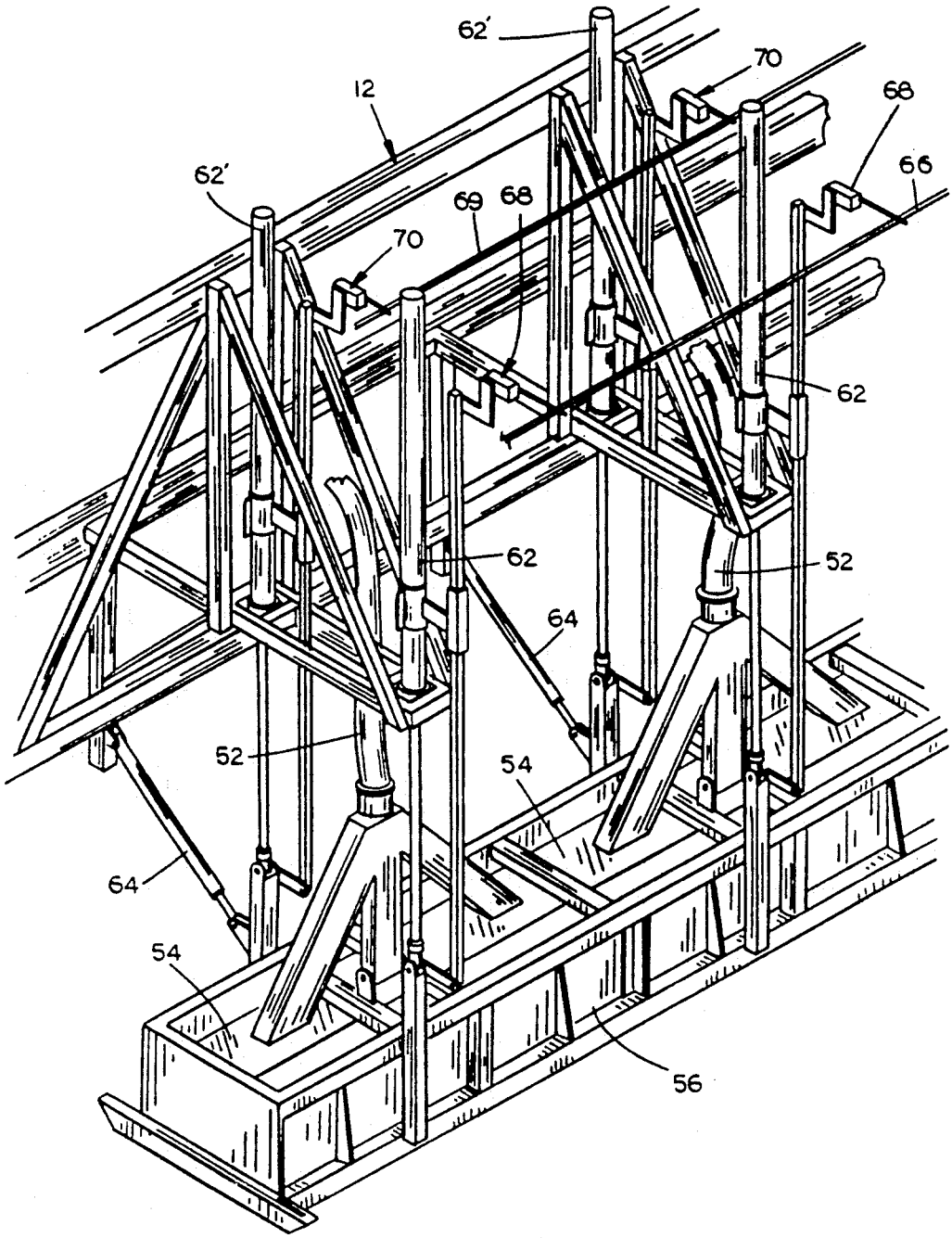
FIG. 14 is a partial rear perspective view of the machine illustrating the rock spreader means and some of the associated structure.
Figure 15:
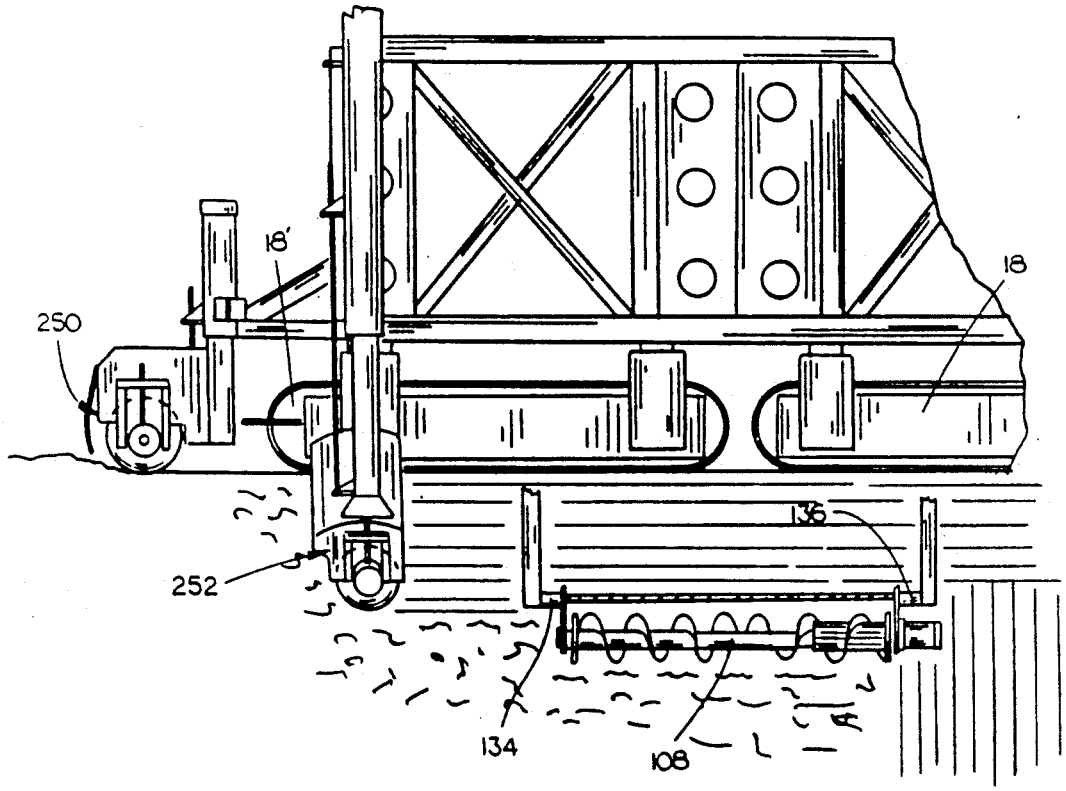
FIG. 15 is a partial sectional view illustrating the relationship of the rotary trimmer and the other trimmers which shape the upper portion of one of the sides of the canal as well as a horizontal portion at the upper end of the canal.
Figure 16:
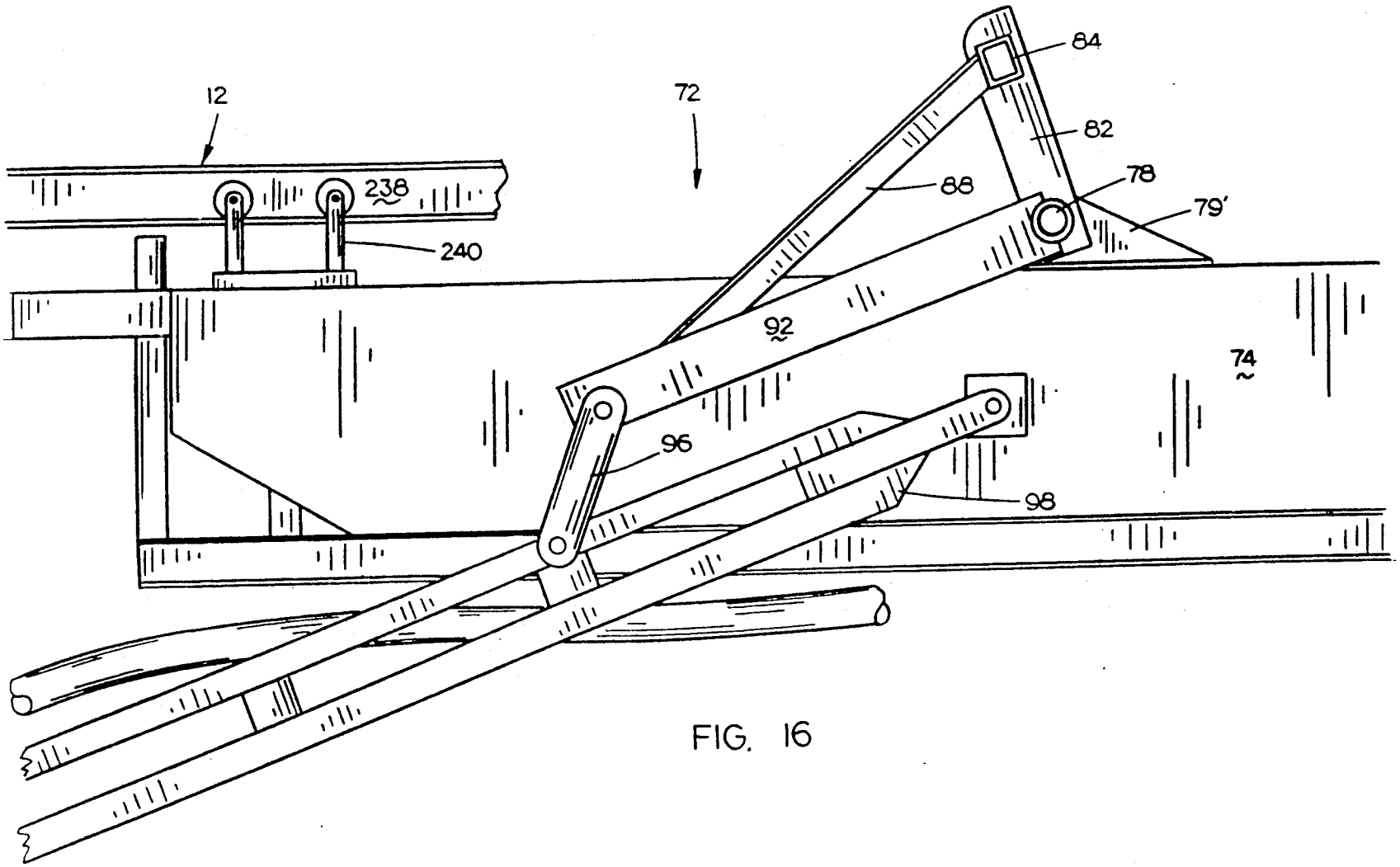
FIG. 16 is a partial side sectional view illustrating the means by which the trimmer boom arms are pivotally connected to the trimming apparatus.

Cable 66 is secured to the frame means 12 adjacent the opposite ends thereof and extends along the length of the frame means 12 as seen in the drawings. A plurality of sensor assemblies 68 are mounted as shown in FIG. 14 to control the operation of one or more cylinders 62. Cable 69 also extends between the ends of the frame means forwardly of cable 66 as seen in the drawings. A plurality of sensor assemblies 70 are mounted as seen in FIG. 14 to control the operation of one or more cylinders 62'. Sensor assemblies 68 and 70 ensure that the spreader means 56 will be maintained at the proper grade.

The numeral 72 refers to a trimming apparatus which is longitudinally movably mounted on frame means 12. Trimming apparatus 72 is basically a dredger sold under the trademark "MUDCAT" by Ellicott Corporation. Trimming apparatus includes a pair of pontoons 74 and 76 which would normally permit the MUDCAT to float in water. In the machine of this invention, the pontoons 74 and 76 only serve to provide a mounting means to secure the apparatus to its supporting structure. The trimming apparatus 72 is mounted on a carriage 77 which rolls along a pair of I-beams extending along the length of the frame means 12 which will be discussed in more detail hereinafter.

Tranversely extending pipe 78 is rotatably mounted in brackets 79 (not shown) and 79' which are secured to pontoons 74 and 76 respectively. Pipe 78 has a pair of horizontally spaced uprights 80 (not shown) and 82 secured thereto and extending upwardly therefrom. Brace 84 is secured to and extends between uprights 80 and 82 below the upper ends thereof as seen in the drawings. A pair of braces 86 (not shown) and 88 are welded to brace 84 and extend downwardly and forwardly therefrom to arms 90 and 92 respectively which have their rearward ends secured to pipe 78. Links 94 (not shown) and 96 are pivotally secured at their upper ends to the forward ends of arms 90 and 92 respectively and are pivotally secured at their lower ends to boom arms 98 and 100 respectively. The rearward ends of boom arms 98 and 100 are pivotally secured to pontoons 74 and 76 respectively. In the conventional MUDCAT structure, a hydraulic cylinder would be pivotally connected to the upper end of each of the uprights 80 and 82 and pivotally connected to the associated pontoon. However, in this apparatus, such clinders are not required.

Trimmer head 106 is secured to the forward ends of boom arms 98 and 100 and includes a transversely disposed trimming auger 108 which has its rotational axis disposed parallel to the length of the canal. Shield or cover 110 extends partially around the forward end of auger 108 and is pivotally mounted on the head 106. Hydraulic cylinders 112 and 114 are operatively connected to cover 110 for pivotally moving cover 110 with respect to head 106 and auger 108 at times.

Frame members 116 and 118 extend horizontally forwardly from carriage 77 and have a pair of uprights 120 and 122 extending upwardly therefrom rearwardly of the forward ends thereof. Boom arms 124 and 126 are pivotally secured at their rearward ends to the upper ends of uprights 120 and 122 and are pivotally moved with respect thereto by a pair of hydraulic cylinders 126 and 128.

Arms 130 and 132 are pivotally connected at their upper ends to the forward ends of boom arms 124 and 126 and extend downwardly therefrom. The lower ends of arms 130 and 132 are pivotally secured to shafts 134 and 136 which extend horizontally outwardly from opposite sides of head 106. Hydraulic cylinders 138 and 140 are operatively pivotally secured to frame members 116 and 118 and have their rods 142 and 144 pivotally secured to opposite ends of head 106.

Trimmer head 106 includes a cowling or housing 146 in which is positioned a dredge pump 148 having its intake 150 positioned adjacent the auger 108 as seen in the drawings. The intake of pump 148 is covered with a grill 152 to prevent rocks from entering the pump 148. Exhaust or discharge pipe 154 extends from pump 148 and is operatively connected to a discharge nozzle or means located laterally of the canal so that mud and water taken into pump 148 is discharged outwardly of the canal.

The numerals 158 and 158' refer to a sensor mounting assemblies which are mounted on arms 130 and 132 respectively as will now be described. Inasmuch as assemblies 158 and 158' are identical, only assembly 158 will be described in detail with "'" indicating identical structure on assembly 158'. Assembly 158 includes a frame means 160 which is secured to arm 130 and which has a hydraulic cylinder 162 secured thereto. One end of the cylinder 162 is connected to slide 164 which is vertically movably mounted on guides 166 and 168. Slide 164 has a shaft or rod 170 extending upwardly therefrom through guide 171 which has a sensor 172 mounted on the upper end thereof including a sensor arm 174 which is adapted to engage the underside of cable 176 which extends from one end of the frame means 12 to the other end thereof. Cable 176' extends from one end of the frame means 12 to the other end thereof which is sensed by assembly 158'.

Cables 176 and 176' include horizontally disposed portions 178 and 178', arcuate portions 180 and 180' and inclined portions 182 and 182'. Hydraulic cylinders 162 and 162' are designed to raise or lower the sensor arms 174 and 174' a distance of approximately two feet when cylinders 162 and 162' are activated as will be described in more detail hereinafter. Sensors 172 and 172' are operatively connected to hydraulic cylinders 138 and 140 to control the operation thereof in response to the position of the sensors relative to the cables 176 and 176' respectively.

The numerals 184 and 184' refer to sensored string line radius assemblies which are positioned on the frame means 12 and which are normally in engagement with the cables 176 and 176' to create a radius therein which will generally correspond to the juncture of the bottom of the canal with one side of the canal. Inasmuch as assemblies 184 and 184' are identical, only assembly 184 will be described in detail with "'" indicating like structure on assembly 184'. Frame members 186 and 188 are horizontally adjustably mounted on frame members 190 and 192 which are selectively vertically mounted on suitable supports S and S' on the frame means 12. Frame member 193 is secured to and extends between the frame members 186 and 188 and has the base end of hydraulic cylinder 194 pivotally secured thereto. The rod 196 of cylinder 194 is pivotally connected to ear 198 which is welded to crankshaft 200 which is rotatably secured to and which extends between frame members 186 and 188. Ears or brackets 202 and 204 are welded to crankshaft 200 and extend therefrom as seen in the drawings. Connect links 206 and 208 are pivotally connected at their upper ends to ears 202 and 204 respectively and are pivotally connected at their lower ends to radius 210. Shafts 212 and 214 are welded to radius 210 at the opposite ends thereof and extend upwardly therefrom and are slidably received by guides 216 and 218 welded to the lower ends of frame members 186 and 188 respectively.

Radius weldment 220 is welded to the lower end of radius 210 and has the cable 176 secured thereto by suitable clamps or the like. Arm 222 is bolted to radius 210 and extends upwardly therefrom and is selectively vertically movably received in tube 224. Arm 222 may be selectively vertically positioned in tube 224 by means of the crank 226. A set screw or the like may be used to maintain the relative position between members 222 and 224 when the desired relationship has been established. Horizontally extending arm 228 is secured to the upper end of tub 224 and has a sensor 230 mounted thereon including sensor arm 232 which is normally in engagement with the string line cable 234 which is secured to and which extends between the supporting frame structure of the tracks 18, 18' and 20, 20' and is not connected to the frame means 12.

Carriage 77 is longitudinally movably mounted on I-beams 236 and 238 of frame means 12 by means of hanger assemblies 240. Carriage 77 is moved along the beams 236 and 238 by means of a double wrapped winch 242 controlled by a reversible hydraulic motor 244. Cable 246 is wrapped around winch 242 and has its opposite ends secured to opposite ends of the frame means 12 or the supporting frame structure for the tracks 18, 18' and 20, 20'. Limit switches 248 are operatively mounted on opposite ends of carriage 72 and are designed to be engaged and activated by actuators clamped onto the cable 246 to cause the carriage 77 to be stopped at a predetermined position when advancing in its trimming mode and to be stopped at a predetermined position when moving in its return mode.

If it has been determined that a particular earthen irrigation canal must be lined and paved, the machine of this invention will be utilized to prepare the canal bottom and sides for lining and paving. In preparation for the trimming operation, a large excavator or the like is used to create the paths 34 and 36 as previously described. The machine 10 is then positioned on the paths 34 and 36 with conventional grade and direction sensing devices being utilized along the paths 34 and 36 so that the machine 10 is properly guided at the proper grade.

Assuming that the machine 10 has been positioned on the paths 34 and 36 as viewed in the perspective view of FIG. 1, the spreader means 56 is lowered downwardly into the water by means of the hydraulic cylinders 62 and 62'. The individual hoppers 40 are filled with rock material by means of the conveyor 42 and the strike-off plate 46. The sensor assemblies 68 and 70 for the hydraulic cylinders 62 and 62' are adjusted so that the spreader means 56 will be located at the proper grade. The sensor assembly 68 will sense the relative position of the rear end of the spreader means 56 with respect to the cable 66 and will actuate the hydraulic cylinders 62 to raise or lower the rearward end of the spreader means 56 to the desired grade. Similarly, sensor assembly 70 senses the relative position of the forward end of the spreader assembly 56 with respect to the cable 69 to actuate the hydraulic cylinders 62' to raise or lower the forward end of the spreader means 56 to the proper grade. As the spreader means 56 is moved along that portion of the trimmed bottom and side of the canal, rock material will pass from the bottom of the spreader means 56, when a low spot in the canal is encountered, to fill the low spots that are present in the bottom of the canal or in the side of the canal.

As the machine 10 is advanced along the length of the canal, trimmer 250 trims and levels that portion of the path 34 immediately in front of the track 20 and augers the trimmed material downwardly onto the upper portion of the side 30 of the canal. Trimmer 250 creates a horizontal surface upon which concrete will be positioned during the lining and paving of the canal. Trimmer 252 is disposed at an angle corresponding to the desired grade of the side 30 and augers the trimmed material downwardly therefrom so that the trimming auger 108 may auger the same into the dredge pump 148 so that the mud or trimmed material may be pumped to a location laterally of the canal such as illustrated in the drawings.

Trimmer 250 may be selectively raised or lowered by hydraulic cylinders 251 while trimmer 252 may be selectively raised or lowered by hydraulic cylinders 253.

The trimming apparatus 72 is initially located towards side 32 of the canal so that the trimming auger 108 may trim at least a majority of the side 32 of the canal 14 and at least one-half of the bottom 28 during its trimming mode.

The sensor mounting assemblies 158 and 158' are initially adjusted to achieve the desired grade. Inasmuch as assemblies 158 and 158' operate identically, only the operation of assembly 158 will be described in detail. Assuming that the trimming auger 108 is in its proper grade position and is in its outermost end of travel, the carriage 77 is moved longitudinally on the frame means 12 by means of the winch 242 so that the trimmer head 106 trims side 32 of the canal and then the bottom of the canal corresponding to the grade as determined by the inclined portion 182 of cable 176 and then the horizontally disposed portion of the cable 176 to control the actuation of hydraulic cylinder 140 to ensure that the canal will be properly trimmmed. As the carriage 77 moves away from side 32 of the canal, the sensor arm 174 moves along the underside of the inclined portion 182 of cable until the radius assembly 210 is reached. As the sensor arm 174 leaves the inclined portion 182 of cable 176, the sensor arm 174 will sense the fact that it is moving into engagement with the arcuate portion 180 and will cause the hydraulic cylinder 138 to be lowered so that the trimmer head 106 will create the radius between the side and the bottom of the canal. As the carriage 77 continues in its trimming mode, the sensor arm 174 senses the underside of the arcuate portion 180 of the cable so that cylinder 138 is continued to be extended and then maintained in position so that the trimmer head 106 will trim the bottom of the canal at the proper grade as determined by the horizontal portion 178 of the cable 176.

When the carriage 77 is at the end of its trimming mode, the movement of the carriage will be stopped by a limit switch 248 thereby discontinuing the operation of the hydraulic motor 244 and winch 242. In order to prevent damage to the trimmer assembly during its return mode, the sensor assemblies 158 and 158' are actuated to lower the sensor arms 174 and 174' with respect to cables 176 and 176' when sensor arms 174 and 174' move out of engagement with the cables 176 and 176', the sensors 172 and 174 actuated hydraulic cylinders to retract the same so that the trimmer head 106 is raised with respect to the canal bottom approximately two feet.

When the trimmer head 106 has been so raised, carriage 77 is moved towards the end of frame means 12 by the double wrapped winch 242 until the limit switch 248 is actuated to stop the return mode of the carriage. When the carriage 77 has reached the end of its return mode, the operator actuates the switch controlling the cylinders 162 and 162, to raise switch arms 174 and 174' relative to arms 130 and 132 thereby causing the cylinders 162 and 162' to be extended until slides 164 and 164' engage the underside of guides 171 and 171, respectively. The switch arms 174 and 174' engage the cables 176 and 176' and actuate hydraulic cylinders 138 and 140 to extend the same thereby lowering trimmer head 106 to the proper grade. During the raising and lowering of trimmer head 106, cylinders 126 and 128 act as dampener cylinders to "smooth out" the operation of cylinders 138 and 140.

It has been found that the weight of the carriage means 77 tends to cause the frame means 12 to deflect downwardly as the carriage 77 moves therealong. Since the downward deflection of the frame means 12 will also cause the downward deflection of the cables 176 and 176', the sensor string line radius assemblies 184 and 184' will also be lowered which would cause the trimmer head 106 to be vertically moved downwardly corresponding thereto since the sensor arms 174 and 174' would be sensing the lowered deflected portion of the cable.

To correct for the deflection of the frame means 12, sensor string line radius assemblies 184 and 184' are provided. Inasmuch as assemblies 184 and 184' are identical, only assembly 184 will be described in detail. As assembly 184 moves downwardly due to the deflection of the frame means 12, sensor arm 232 moves out of engagement with the cable 234 which causes the actuation of cylinder 194 to retract the same so that crankshaft 200 rotates thereby vertically moving connect links 206 and 208 upwardly which causes the radius to tend to be moved upwardly and the switch arm 232 until the switch arm 232 again senses the location of cable 234 at which time cylinder 194 is deactivated. The radius assembly functions in an opposite manner when frame means 12 moves upwardly when the carriage means 77 is not causing the downward deflection of the frame means 12. Thus it can be seen that a novel radius assembly has been provided which not only permits the string line cables to be radiused into the proper configuration but which also automatically compensates for any deflection of the frame means 12 as the carriage moves longitudinally thereon.

When at least one-half of the canal bottom and one side thereof have been trimmed, the machine is reversed 180° at a siphon location and moved back along the length of the canal to trim side 30 and the remainder of the bottom of the canal.

We claim:

1. An apparatus for trimming the bottom and sides of an earthen irrigation canal having water therein, comprising, an elongated frame means extending transversely across the canal and having opposite ends, a forward end and a rearward end, propulsion means on the ends of said elongated frame means for propelling said frame means at least forwardly along the length of the canal, means for raising and lowering said frame means relative to said propulsion means, a first trimmer means selectively longitudinally movably mounted on said frame means and having an elongated rotary trimmer mounted thereon, the longitudinal axis of said rotary trimmer being disposed parallel to the length of the canal for trimming at least a portion of the bottom and at least a portion of one of the sides of the canal as the first trimmer means is moved longitudinally on said frame means, means for vertically moving said rotary trimmer, said first trimmer means including a dredge pump means for pumping the material trimmed by said rotary trimmer to a location outside of the canal, an elongated spreader means mounted on said frame means rearwardly of said first trimmer means which is normally positioned in the water of the canal closely adjacent at least a portion of the trimmed canal to fill low spots in the trimmed canal with rock material, hopper means on said frame means above said spreader means for storing rock material thereon, means for supplying said rock material to said hopper means, and means connecting said hopper means with said spreader means for supplying said rock material to said spreader means.

2. The apparatus of claim 1 wherein said elongated spreader means extends along at least a portion of the bottom of the canal and along at least a portion of one of said sides of said canals.

3. The apparatus of claim 1 wherein a first guidance means is provided for vertically guiding said rotary trimmer relative to the desired grade to be created in the canal as said first trimmer means is moved along the length of said frame means.

4. The apparatus of claim 1 wherein said first guidance means comprises at least a first cable means secured at one end to one end of said frame means and secured at its other end to the other end of said frame means, said cable means comprising a substantially horizontally disposed portion, having first and second ends, extending from said one end of said frame means towards said other end of said frame means, said first end of said first horizontally disposed portion being secured to said frame means adjacent said one end thereof, said cable means also including an arcuate portion extending upwardly and outwardly from said second end of said first horizontally disposed portion, and an inclined portion extending upwardly and outwardly from said arcuate portion, said horizontal, arcuate and inclined positions substantially defining the desired trimming grade of at least a portion of said bottom, at least a portion of one of said side walls of said canal and the juncture thereof, a hydraulic cylinder means operating connected to said rotary trimmer for raising and lowering said rotary trimmer relative to said frame means, a cable sensor means operatively mounted on said first trimmer means which is operatively connected to said hydraulic cylinder means for controlling the operation thereof so that said rotary trimmer is raised or lowered in response to said cable sensor means sensing the position of said first trimmer means with respect to said horizontal, arcuate and inclined portions of said cable means so that said rotary trimmer will be automatically raised or lowered to create the desired grade in the canal.

5. The apparatus of claim 1 wherein said propulsion means at each end of said frame means comprises a crawler track means and wherein a second powered trimmer means is connected to said frame means at said second end forwardly of said crawler track means at said second end of said frame means for trimming a horizontally disposed portion at the upper end of the side of the canal.

6. The apparatus of claim 5 wherein an inclined, powered trimmer means is connected to said frame means adjacent said second trimmer means and inwardly thereof towards the canal for grading the upper portion of the associated side wall of the canal.

7. The apparatus of claim 5 wherein hydraulic cylinders are operatively connected to said second trimmer means for raising and lowering said second trimmer means.

8. The apparatus of claim 6 wherein said inclined trimmer means has upper and lower ends and wherein a hydraulic cylinder means is operatively connected to the upper and lower ends of said inclined trimmer means for raising and lowering the ends thereof.

9. The apparatus of claim 1 wherein said hopper means comprises a plurality of hoppers positioned on said frame means, said means for supplying rock material to said hopper means comprising an elongated conveyor means positioned over said hopper means for conveying rock material thereon over said hoppers and a movable strike-off assembly selectively movably mounted adjacent the upper surface of said conveyor for diverting rock material from said conveyor downwardly into one of said hoppers, and means for selectively positioning said strike-off assembly relative to said hoppers.

10. The apparatus of claim 1 wherein said spreader means includes a horizontally disposed portion and an inclined portion hingedly secured thereto and wherein a guidance means is provided for raising and lowering said spreader means to the desired grade.

11. The apparatus of claim 3 wherein said guidance means comprises at least one cable secured to and extending between the opposite ends of said frame means, and a sensor means on said first trimmer means which senses the location of said cable and raises and lowers said rotary trimmer corresponding thereto as said first trimmer means is moved longitudinally on said frame means.

12. The apparatus of claim 11 wherein said cable includes a horizontally disposed portion which is disposed above the bottom of the canal and which generally corresponds to the desired grade to be created in the bottom of the canal, said horizontally disposed portion terminating at an inner end which is positioned above the approximate juncture of the bottom of the canal and one of the sides of the canal, an arcuate portion at the end of said horizontally disposed portion having a configuration generally corresponding to the desired grade of the juncture of the canal bottom and side, and an inclined portion extending upwardly from said arcuate portion generally corresponding to the desired grade to be created in the side of the canal, said sensor means following along and sensing said horizontal, arcuate and inclined portions.

13. The apparatus of claim 12 wherein a radius assembly is mounted on said frame means and is in engagement with said cable to change the orientation of said horizontal portion to said arcuate portion and thence to said inclined portion.

14. The apparatus of claim 13 wherein said radius assembly has a lower end which is in engagement with said cable and wherein said radius assembly may be raised and lowered relative to said frame means, and means for automatically raising and lowering said radius assembly relative to said frame means to enable said radius assembly to compensate for vertical deflections in said frame means.

15. The apparatus of claim 14 wherein said guidance means comprises a pair of horizontally spaced-apart cables having a pair of independently operable radius assemblies associated therewith.

16. The apparatus of claim 15 wherein said guidance means includes a pair of horizontally spaced-apart sensors mounted on said first trimmer means for sensing said pair of cables.

17. The apparatus of claim 16 including means for selectively vertically moving said sensors to enable said rotary trimmer to be moved upwardly out of canal engagement to enable said first trimmer means to be moved relative to said frame means during a return mode.

18. The apparatus of claim 17 wherein said means for selectively vertically moving said sensors permits said sensors to be moved selectively upwardly or downwardly relative to said cables to cause the repositioning of said rotary trimmer.

19. The apparatus of claim 1 including means for automatically raising and lowering said first trimmer means in response to a predetermined grade means for the bottom and at least one side of the canal.

20. The apparatus of claim 1 including means for automatically raising and lowering said spreader means in response to a predetermined grade means for the bottom and at least one side of the canal.

21. An apparatus for trimming the bottom and sides of an earthen irrigation canal having water therein, comprising, an elongated frame means extending transversely across the canal and having opposite ends, a forward end and a rearward end, propulsion means on the ends of said elongated frame means for propelling said frame means at least forwardly along the length of the canal, means for raising and lowering said frame means relative to said propulsion means, a first trimmer means selectively longitudinally movably mounted on said frame means and having an elongated rotary trimmer mounted thereon, the longitudinal axis of said rotary trimmer being disposed parallel to the length of the canal for trimming at least a portion of the bottom and at least a portion of one of the sides of the canal as the first trimmer means is moved longitudinally on said frame means, means for vertically moving said rotary trimmer, said first trimmer means including a dredge pump means for pumping the material trimmed by said rotary trimmer to a location outside of the canal, an elongated spreader means mounted on said frame means rearwardly of said first trimmer means which is normally positioned in the water of the canal closely adjacent at least a portion of the trimmed canal to fill low spots in the trimmed canal with rock material, hopper means on said frame means above said spreader means for storing rock material thereon, means for supplying said rock material to said hopper means, means connecting said hopper means with said spreader means for supplying said rock material to said spreader means, said elongated spreader means extending along at least a portion of the bottom of the canal and along at least a portion of one of said sides of said canals, a first guidance means for vertically guiding said rotary trimmer relative to the desired grade to be created in the canal as said first trimmer means is moved along the length of said frame means, said first guidance means comprising a pair of horizontally spaced-apart cables secured to the ends of said frame means and extending therebetween, a pair of horizontally spaced-apart cable sensors mounted on said first trimming means in engagement with said pair of cables, said cable sensors being operatively connected to said means for vertically moving said rotary trimmer so that said rotary trimmer is automatically raised and lowered corresponding to the sensed longitudinal location of said first trimmer means relative to said pair of cables.

22. The apparatus of claim 21 Wherein each cable of said pair of cables includes a horizontally disposed portion positioned above the bottom of the canal, a radius portion positioned above the juncture of the canal bottom and one of the canal sides, and an inclined portion disposed above the canal side.

23. The apparatus of claim 22 further including means for selectively raising and lowering said cable sensors relative to said pair of cables.

24. The apparatus of claim 22 wherein a pair of selectively adjustable radius assemblies are mounted on said frame means for creating the radius portions of said pair of cables.

25. The apparatus of claim 24 wherein each of said radius assemblies are selectively vertically mounted on said frame means.

26. The apparatus of claim 24 wherein each of said radius assemblies are selectively horizontally mounted on said frame means.

27. The apparatus of claim 24 wherein said propulsion means at each end of said frame means includes a support structure which is selectively vertically movable relative to the canal, and wherein a second pair of horizontally disposed and spaced cables are secured to the support structures and extend therebetween, each of said radius assemblies being vertically movable relative to said frame means, means for vertically moving each of said radius assemblies, each of said radius assemblies including a cable sensor means which is operatively connected to said means for moving the respective radius assembly and which senses the associated cable of said second pair of cables to automatically vertically move the associated radius assembly to compensate for vertical deflections in said frame means.

28. An apparatus for trimming the bottom and sides of an earthen irrigation canal having water therein, comprising, an elongated frame means extending transversely across the canal and having opposite ends, a forward end and a rearward end, propulsion means on the ends of said elongated frame means for propelling said frame means at least forwardly along the length of the canal, means for raising and lowering said frame means relative to said propulsion means, a trimmer means mounted on said frame means for trimming at least a portion of the bottom and at least a portion of one of the sides of the canal as the first trimmer means is moved longitudinally on said frame means, means for vertically moving said trimmer means, said trimmer means including a dredge pump means for pumping the material trimmed by said rotary trimmer to a location outside of the canal, an elongated spreader means mounted on said frame means rearwardly of said trimmer means which is normally positioned in the water of the canal closely adjacent at least a portion of the trimmed canal to fill low spots in the trimmed canal with rock material, hopper means on said frame means above said spreader means for storing rock material thereon, means for supplying said rock material to said hopper means, means connecting said hopper means with said spreader means for supplying said rock material to said spreader means, and a guidance means operatively connected to said means for vertically moving said trimmer means for automatically vertically moving said trimmer means relative to the desired grade to be created in the canal as said trimmer means is moved along the length of said frame means.

* * * * *